United States Patent [19]

Nomi

[11] 4,340,384

[45] Jul. 20, 1982

[54] COLORED, POROUS FLUOROCARBON MATERIAL AND METHOD FOR ITS MANUFACTURE

[75] Inventor: Haruo Nomi, Tanashi, Japan

[73] Assignee: Junkosha Co., Ltd., Tokyo, Japan

[21] Appl. No.: 240,321

[22] Filed: Mar. 4, 1981

[30] Foreign Application Priority Data

Mar. 12, 1980 [JP] Japan ..... 55-31357

[51] Int. Cl.[3] ..... D06P 3/00; B32B 5/14; D06P 5/00

[52] U.S. Cl. ..... 8/495; 8/506; 8/510; 8/513; 427/171; 428/421; 428/422

[58] Field of Search ..... 8/495, 506, 510, 513, 8/385.5; 428/421, 422; 427/171

[56] References Cited

U.S. PATENT DOCUMENTS

| | | | |
|---|---|---|---|
| 3,962,153 | 6/1976 | Gore | 428/422 |
| 4,143,204 | 3/1979 | Fang | 427/385.5 |
| 4,165,404 | 8/1979 | Quehl | 428/421 |
| 4,194,041 | 3/1980 | Gore et al. | 428/422 |
| 4,271,217 | 6/1981 | Tanaka et al. | 427/389.9 |

FOREIGN PATENT DOCUMENTS

| | | | |
|---|---|---|---|
| 48-5262 | 2/1973 | Japan | 427/385.5 |
| 50-5738 | 3/1975 | Japan | 427/385.5 |

*Primary Examiner*—Maria Parrish Tungol
*Attorney, Agent, or Firm*—Mortenson & Uebler

[57] ABSTRACT

A colored, porous fluorocarbon material is provided wherein a porous layer of a colored dyeing-site resin is formed on all surfaces of the fluorocarbon material. This new material is made by a process whereby an auxiliary solvent which does not readily dissolve a dyeing-site resin, if at all, is added to a solution of the dyeing-site resin in a main solvent, and this is coated onto the surfaces of the fluorocarbon material and dried. The material may be dyed by adding dyestuff to the aforesaid solution or it may be dyed after coating and drying. The coated fluorocarbon material can be stretched.

6 Claims, No Drawings

COLORED, POROUS FLUOROCARBON MATERIAL AND METHOD FOR ITS MANUFACTURE

BACKGROUND OF THE INVENTION

The present invention relates to a colored product of a porous fluorocarbon resin material and a method for its manufacture, specifically for the purpose of achieving the coloring with brightness and fastness to various factors while avoiding any substantial degradation of the excellent gas and moisture permeability and water proofing properties inherent in porous fluorocarbon material of continuous porosity.

Generally fluorocarbon resins, represented typically by polytetrafluoroethylene (hereinafter abbreviated as PTFE), are excellent for their thermal and chemical resistance, surface slipperiness and other properties when compared with other resins and are processed by various methods to produce products of various types for wide use in a wide range of applications.

The porous fluorocarbon resin material having continuous porosity (hereinafter referred to simply as the porous fluorocarbon resin material), which makes possible the coloring object of the present invention, itself has extensive applications. For example, the porous material of PTFE is excellent in softness, lightness, gas and moisture vapor permeability, waterproofness, touch, handling and other properties in addition to other excellent properties inherent in the said resin. This material is utilized, for example, as a material for various artificial body organs such as blood vessels, for patches and oxygenating membranes and for medical equipment such as diaphragms of various types, filters, flexible packings, etc. Also, PTFE in the form of a thin porous film is utilized, after being laminated with a woven or nonwoven base cloth, for jackets and feathercoats or other clothes which require gas and moisture vapor permeability characteristics together with waterproofness. The method of manufacture of the porous material of PTFE used in this invention is known, for example in Japanese Patent Publication No. Sho-48-44664 (1973), Japanese Patent Disclosure No. Sho-46-7284 (1971) and Japanese Disclosure Sho-50-2281 (1975). It is possible to manufacture expanded porous PTFE material in the form of sheet, tube, bar, filament and other various types by baking or thermo-setting at an elevated temperature (200° C.–327° C.). By varying the stretch ratio and other manufacturing conditions, the properties of the porous products may be controlled. Porosity, average pore size, Gurley number and thickness can be produced in the ranges of about 20–90%, 0.01–30 microns, 0.01–5000 seconds and 0.005 millimeters minimum, respectively. Thus, a material suitable for the object of this invention can be obtained easily. It is noted that "Gurley" number represents the time required for 100 cc of air to permeate a section of material having a diameter of 2.54 cm under a pressure of 12.7 mm $H_2O$ pressure.

However, since the excellent chemical resistance, water repellency and other properties of fluorocarbon resins result in poor dyeability, the said resins, solid or porous, usually have poor color properties, and it is very difficult to obtain a good, colored product.

In view of the above, the inventor previously offered a method for satisfactorily coloring porous materials of fluorocarbon resins (Japanese Patent Disclosure No. Sho-53-60949 (1978). In that method, the porous fluorocarbon resin material was impregnated with a solvent solution of a resin which produces the dyeing sites, i.e. a resin which has excellent dyeability. The impregnated material was dried and then dyed; or, the porous fluorocarbon resin material was impregnated with a solution containing that resin which makes the dyeing sites and a dyestuff, then dried.

Thus, when the porous fluorocarbon resin material was impregnated with the resin that produces the dyeing sites and was dried, the solvent of the resin solution was evaporated leaving the solid resin, thinly coating in a continuous manner, all the circumferential surfaces of fine fibers and nodes of complex fibril tissues which form the framework of the respective fine pores of the porous fluorocarbon material, and therefore, even though the residual resin and the fluorocarbon resin do not adhere to each other well, the said residual resin will no longer easily fall off under this condition because it encloses and coats continuously and thinly the respective fibers and nodes of the porous material. In addition, since the resin coating is thin and does not clog the pores of the porous, fluorocarbon material, no characteristics inherent in the porous tissue would be impaired.

Therefore, when the porous fluorocarbon resin material, impregnated with a resin solution which produces the said dyeing sites is dried and then dyed according to the previous method, the dyeing-site resin will easily be dyed bright, so that the entire porous fluorocarbon resin material could be colored bright and fast without substantial degradation of the characteristics inherent in the porous material. After the dyeing, any residual dyestuff present in excess or unfixed was removed by washing. Drying the prepared material produced the colored final product.

When the resin solution was added with the dyestuff beforehand, a porous product which was colored bright and fast was obtained by impregnating the porous fluorocarbon resin material by the said solution and subsequently drying. In that case, the final colored product was then prepared by washing and drying.

In view of the above coloring principle, the dyeing-site resin solution used in the above method of the previous invention had the following requirements:

(a) It smoothly permeates the fine fibril tissue of the porous material, i.e. the porous matrix.

(b) The resin content of the resin solution which has permeated the porous matrix and which has covered the outer surfaces of the porous material will be left, after drying, in the form of a thin coating film around each fine fiber and fine node of the porous fibril matrix. Thus, in order to retain substantially the gas permeability of the porous material, neither pores in the matrix nor pore openings in the surface of the porous material will be clogged by the resin film (the continuously coating resin film layer).

It was essential, therefore, to use a resin solution of rather low concentration, and in that method the concentration of the resin solution was limited practically to as low a value as possible, about 10% at the most. Thus, the mixing dose of the dyestuff was also limited.

Nevertheless, there is a very close correlation between the dyeing-site resin and the resulting dyeing brightness. That is, the larger the resin dose, the better the dyeing brightness. In addition to the dyeing brightness, the dyeing fastness improves generally with increases in resin dose. For example, it is known that degradation by light of the dyeing fastness increases with decreasing resin dose.

Even though the prior dyeing method has a coloring effect much better than any previous conventional method, there was a certain limit to improvement in dyeing brightness and fastness due to the said limit in the application dose of resin and dyestuff.

Using the same dyeing-site resin and dyestuff, the present invention enables the use of increased doses and offers a colored, porous fluorocarbon resin material having not only an adequate gas and moisture permeability and waterproofing property but also better dyeing brightness and fastness than the method of the previous invention mentioned above. This also applies to its manufacturing method.

SUMMARY OF THE INVENTION

A colored, porous fluorocarbon material is provided wherein all surfaces of a base material of a porous fluorocarbon material are coated with a porous coating layer of a dyeing-site resin. The preferred fluorocarbon material is expanded polytetrafluoroethylene.

The method for producing the new material of this invention is one wherein a coating solution is applied to a porous fluorocarbon material, the coating solution comprising a dyeing-site resin dissolved in a main solvent and an auxiliary solvent, which auxiliary solvent does not readily dissolve, if at all, the dyeing-site resin. This coated fluorocarbon material is dried, dyed and stretched to form the new colored, porous fluorocarbon material.

DETAILED DESCRIPTION OF THE INVENTION AND PREFERRED EMBODIMENTS

The gist of the colored, porous fluorocarbon resin material of this invention lies in the feature that a porous layer of dyeing-site resin is formed on its outer surface. And, concerning the manufacturing method of the said porous fluorocarbon resin material, the gist lies in the feature that a resin liquid, containing the solvent for the dyeing site resin, the dyeing-site resin itself, and a second solvent which does not readily dissolve, if at all, the dyeing-site resin is coated on the surfaces of the porous fluorocarbon resin material, dried and then the porous fluorocarbon resin material is stretched. Alternatively, a resin liquid, containing the solvent, resin and second solvent which does not readily dissolve, if at all, the said resin, is coated on the surfaces of the porous fluorocarbon resin material, dried and then stretched and dyed, or first dyed and then stretched.

Unlike the previous proposal mentioned above, the colored porous fluorocarbon resin material of the present invention is not prepared by impregnation of the porous matrix of the porous fluorocarbon resin material by the coloring liquid and subsequent drying, but is done by forming a porous layer of colored dyeing-site resin on the outer surfaces of the porous fluorocarbon resin material, so that there is no limit in the application dose of the dyeing-site resin and dyestuff. Thus, by increasing the application dose it is possible to manufacture a product possessing improved dyeing brightness and fastness. Moreover, since the colored layer is porous, the gas and moisture permeability of the said colored porous fluorocarbon resin material is retained substantially in its entirety. Also, the porous matrix, inherent in fluorocarbon resins, of the porous fluorocarbon resin material is retained as it is. And, finally, the excellent waterproofness property inherent in the said material is retained fully.

Referring to that solvent which dissolves the dyeing-site resin as the main solvent and the second solvent which does not readily dissolve, if at all, the resins as the auxiliary solvent, the manufacturing method of the colored porous fluorocarbon resin material of the present invention will be given in detail.

The inventor has found that when the resin solution formulated from the dyeing-site resin and the main solvent, with or without a dyestuff added, is coated on the surfaces of porous fluorocarbon resin material and dried, the dyeing-site resin makes a continuous coating surface layer of a substantially solid matrix on the porous fluorocarbon resin material faces. If the resin concentration of the resin solution is high, this can result in a clogging of each pore opening of the porous fluorocarbon material and eventually in the loss of its gas and moisture permeability. However, in the case where a resin solution formulated from the dyeing-site resin and the main solvent and the auxiliary solvent of an optimum dose, with or without a dyestuff added, is coated on the same porous fluorocarbon resin material face, the coating surface layer of the dyeing-site resin formed on the porous fluorocarbon resin material is porous even if the resin concentration of the resin solution is quite high.

This pore-making effect is believed ascribable to the fact that, in the presence of the auxiliary solvent, the main solvent has a lower capacity for dissolving the dyeing-site resin to the extent that the resin no longer makes a complete solution. However, the pores of the porous coating surface layer of the dyeing-site resin are very fine, and the gas and moisture permeability of the said layer itself is low.

In the present invention, therefore, the porous fluorocarbon resin material, after the coating of the resin liquid and drying, undergoes the stretch treatment, whereby the porous coating surface layer is also stretched and, therefore, the respective fine pores of this layer are enlarged or countless fine cracks are produced, resulting in a substantial enlargement of each pore. Thus, the gas and moisture permeability of the entire porous coating surface layer of the dyeing-site resin is improved drastically.

It is noted that the porous coating layer of the dyeing-site resin is formed by being rooted in the porous matrix of the surface layer of the porous fluorocarbon resin material and the danger of the layer peeling off is prevented.

The manufacturing method of the present invention is based on the principle described above and, therefore, when the resin liquid consisting of the dyeing-site resin and the main solvent and the auxiliary solvent and the dyestuff is coated on a porous fluorocarbon resin material surface, then dried and stretched, a colored porous fluorocarbon resin material may be obtained, with its colored layer being a porous coating surface layer already colored, and having good gas and moisture permeability, in its entirety. In this case, unlike the previous invention described above, the respective fine fibers and nodes of the matrix which ensure that the matrix of the porous fluorocarbon resin material holds the surfaces of the original fluorocarbon resin material in place, and the excellent waterproofness property inherent in the porous fluorocarbon resin material is retained fully without any substantial degradation. Moreover, it is possible to use the resin liquid at a higher concentration of the dyeing-site resin and dyestuff. Thus, it is possible to obtain a product having improved dyeing brightness and fastness than that of the previous invention described above.

In the actual processing, the washing process follows the coating and drying of the resin liquid or the stretch treatment in order to wash away any dyestuff residues present in excess or unfixed before the final product is obtained. In addition, the stretch treatment tends to cause roughness on the colored layer surface, and an iron roll (hot roll) treatment, for example, is practiced if necessary to finish the product. This iron roll treatment produces no known adverse effects on the gas and moisture permeability of the colored layer provided the temperature is optimized.

Also, as a variation in procedure, the resin liquid containing the dyeing-site resin and the main solvent and the auxiliary solvent may be used without the addition of dyestuff, wherein it is coated on the porous fluorocarbon resin material surfaces and dried. After drying, the porous fluorocarbon resin material can be stretched and dyed (dyeing of the dyeing-site resin layer), or first dyed and then stretched, with the same coloring result as the case described above. Thus, the porous fluorocarbon resin material may be colored with excellent dyeing brightness and fastness while avoiding any substantial degradation in its excellent gas and moisture vapor permeability and waterproofness properties.

In the present invention, although it is possible in principle to use the dyeing-site resin at quite high concentrations in the resin liquid, a concentration in the range, for example, of 5–20 weight % is normally used in practice taking into consideration the softness, handling and touch of the product as well as the workability in the coating process.

The mixing ratio of the auxiliary solvent differs depending on the dyeing-site resin to be used, the type of the main and auxiliary solvents and the predetermined resin concentration, and this is impossible to specify in general terms. Therefore, the optimum mixing ratio is determined on a case-by-case preliminary test. Generally, when the mixing dose is under the optimum range, a poor pore-making effect is produced whereas, when it is excessive, a gelation or precipitation of the resin takes place and this makes even coating impossible. For example, where:

Polyacrylonitrile is used as the dyeing-site resin,

Dimethyl formamide and acetone is used as the main solvent, and

Isopropyl alcohol is used as the auxiliary solvent the optimum mixing ratio of isopropyl alcohol, the auxiliary solvent, is about 15–25 weight % provided that the resin concentration is 10–15 weight %. When perchloroethylene is used as the auxiliary solvent, it is necessary to increase its mixing ratio.

In the case where dyestuff is added to the resin solution beforehand, its concentration is optimized by the desired saturation of the colored product.

The resin liquid may be coated properly by brush coating, spray coating, flow-in coating, gravure coating or other suitable method. Also, the coating layer may be formed by repeating the coating process several times.

Drying may be achieved by either the air seasoning or the forced drying method by heating.

In the stretch treatment, if the stretch ratio is small the degree of enlargement of each pore size of the colored porous dyeing-site resin layer will be small and the generation of cracks will be too small to achieve any substantial increase in the gas and moisture permeability. With increasing stretch ratio, the enlargement of the respective pores or the crack generation will increase. However, owing to various factors such as the tensile strength of both the porous fluorocarbon resin material and the dyeing-site resin layer, and also the tensile strength of the backing material if the porous fluorocarbon resin material is backed by another laminate material, degradation in the dye saturation and roughness occurs on the surface due to the stretch treatment. An optimum stretch ratio is determined taking such factors into account. The stretch ratio in the range of 10–30% gives a good enlargement of the pores in most cases and thus the layer is made excellent in gas and moisture permeability. Either mono-axial or multi-axial stretching may be applied effectively. Although the stretch treatment is practiced at room temperature normally, it may also be done, as required, by heating up to an optimum temperature not exceeding the melting point (or decomposition point) of the dyeing-site resin, the dyestuff or the laminated base cloth.

In addition, the dyeing-site resin may be selected optionally for use from conventional, well known dyeing resins of various types but, in order to achieve a good enlargement of the pore size as described above with a relatively small stretch ratio, it is preferable to select and use those resins of the polyacrylonitrile type which make the resin layer low in elastic recovery and elongation in the stretch treatment.

Concerning porous fluorocarbon resin materials to be colored, the present invention applies effectively to any of those which are baked or semibaked (thermo-set) or untreated.

EXAMPLE 1

| | Weight % |
|---|---|
| The dyeing-site resin: | |
| Kanekaron S (An acrylic resin product of Kanegafuchi Chem. Ind. Co., Ltd.) | 8.2 |
| Pandex (A polyurethane resin product of Dainippon Ink & Chemicals, Inc.) | 2.2 |
| The main solvent: | |
| Acetone | 24.6 |
| Methyl ethyl ketone | 40.3 |
| Dimethyl formamide | 4.9 |
| The auxiliary solvent: | |
| Isopropyl alcohol | 18.8 |

All of the above dyeing-site resin, main solvent and auxiliary solvent were placed in a stirring vessel and dissolved or dispersed while stirring to make a homogeneous solution (or dispersion). To 10 kg of this solution was added 40 g of Cation Yellow-RLH (a yellow cationic dye product of Hodogaya Chemical Co., Ltd.) as the dyestuff, and the contents in the vessel attached with a condenser were stirred for 2 hours while heating in an 80° C. water bath, then left to stand to cool naturally to room temperature. Thus, a coloring treatment liquid was prepared.

Gore-Tex® fabric (a laminate product of W. L. Gore & Associates, Inc., Elkton, Md. comprising a porous PTFE layer and a nylon knit base cloth was used as the material to be colored according to this invention. It is noted that the porous PTFE layer of this Gore-Tex fabric had the following characteristics: Mean pore size 0.2 microns; percent voids 80%; gas permeability (Gurley number) 50 sec. maximum; moisture permeability 3000 g/m$^2$/24 hr minimum; and water entry pressure 5 kg/cm$^2$.

The coloring treatment liquid prepared as described above was coated evenly on the porous PTFE surface of the Gore-Tex fabric with a gravure roll coater and dried while volatilizing the main and auxiliary solvent (the coating layer thickness after the drying was about 5 microns).

After the coating layer was dry, the Gore-Tex fabric was stretched by 20% along its entire width with a tenter-frame. Then it was washed and finished at 150° C. with an iron roll having smooth circumferential surfaces. A surface colored Gore-Tex fabric was obtained.

It is noted that the isopropyl alcohol used as the auxiliary solvent is very poor in its capacity for dissolving acrylic resins and polyurethane resins. Apart from isopropyl alcohol described above, methyl alcohol, ethyl alcohol, toluene, water or the like may also be used as the auxiliary solvent in the case of this particular application example.

EXAMPLE 2

A colored fabric was prepared as in application Example 1 except that the auxiliary solvent was changed to perchloroethylene, 18.8 weight %; the dyestuff and the stretch ratio were also changed to Basacryl Blue-X-3 GLK (a blue cationic dye product of Bayer A.G.), 50 g and 15%, respectively, and all other conditions were the same as in application Example 1. A colored Gore-Tex fabric product was obtained.

COMPARISON EXAMPLE 1 (an example without the stretch treatment)

A colored Gore-Tex fabric product was obtained as in Example 1 excluding the stretch treatment among the processes of application Example 1. The iron roll finishing was also omitted as a matter of course.

COMPARISON EXAMPLE 2 (the same)

A colored Gore-Tex fabric product was obtained as in Example 2 excluding the stretch treatment among the processes of application Example 2. The iron roll finishing was also omitted as a matter of course.

COMPARISON EXAMPLE 3 (an example without any auxiliary solvent added)

| | Weight % |
|---|---|
| The dyeing-site resin: | |
| Kanekaron | 8.2 |
| Pandex | 2.3 |
| The main solvent: | |
| Acetone | 34.0 |
| Methyl ethyl ketone | 49.7 |
| Dimethyl formamide | 4.8 |

The above dyeing-site resin and main solvent were placed in a stirring vessel and dissolved while stirring to make a homogeneous solution. To 10 kg of this solution was added 40 g of Cation Yellow RLH, as the dyestuff, and treated in the same way as in Example 1. Thus, a coloring treatment solution containing no auxiliary solvent was prepared.

The coloring of Gore-Tex fabric was practiced using this coloring treatment solution containing no auxiliary solvent by the same procedure as in application Example 1.

The respective colored Gore-Tex fabric products obtained in the application Examples 1 and 2 and Comparison Examples 1–3 described above were measured for gas permeability, moisture permeability and water permeability pressure, and the results are given in the following Table 1. The moisture permeability test was carried out according to the standard. ASTM-E96-66BW (American Society for Testing and Materials).

TABLE I

| Testing Item | Application Example 1 | Application Example 2 | Comparison Example 1 | Comparison Example 2 | Comparison Example 3 |
|---|---|---|---|---|---|
| Gas permeability, Gurley number, sec | 50–100 | 50–100 | 2000 | 2000 | 800 |
| Moisture permeability, g($H_2O$)/m$^2$ . 24 hr | 3000–4000 | 3000–4000 | 1000 max. | 1000 max. | 1000–2000 |
| Water permeability pressure, kg/cm$^2$ | 5 | 5 | 5 | 5 | 5 |

The colored products obtained in application Examples 1 and 2 according to the present invention retain their original gas permeability (50 sec maximum), moisture permeability (3000 minimum) and water permeability pressure (5) without any substantial degradation. On the other hand, those of Comparison Examples 1 and 2 (without the stretch treatment) and 3 (without any auxiliary solvent added) are all poor in gas and moisture permeability in their entirety, due to the low gas and moisture permeability of the colored layer itself.

In addition, the respective products of application Examples 1 and 2 and Comparison Examples 1–3 were tested for color fastness against various factors, i.e. light (JIS-L-0841), washing (JIS-L-0844 B-3), dry cleaning (JIS-L-0860), perspiration (JIS-L-0848) and abrasion (JIS-L-6547). As a result, all the products proved a color fastness in Class 4–5 for light, Class 4 for washing, Class 4 for dry cleaning, Class 5 for perspiration and Class 5 for abrasion. It is noted that, in said test results, each of the fastness values with the exception of that against light indicates either a change in color or staining, whichever is lower.

While the invention has been disclosed herein in connection with certain embodiments and detailed descriptions, it will be clear to one skilled in the art that modifications or variations of such details can be made without deviating from the gist of this invention, and such modifications or variations are considered to be within the scope of the claims hereinbelow.

What is claimed is:

1. A colored, porous material comprising a base material of porous, expanded polytetrafluoroethylene having a microstructure consisting of nodes interconnected by fibrils, the surfaces of said nodes and fibrils having a porous coating layer thereon comprising a dyeable resin.

2. The material of claim 1 wherein said porous coating layer contains a dye.

3. The method of preparing a colored, porous material comprising:

(a) applying a coating solution to a porous, expanded polytetrafluoroethylene material having a microstructure consisting of nodes interconnected by fibrils, said coating solution comprising a dyeable resin dissolved in a main solvent and an auxiliary solvent, which auxiliary solvent does not readily dissolve, if at all, said dyeable resin, (b) drying said coated material, (c) dyeing said coated material, and (d) stretching said coated material.

4. The method of claim 3 wherein said dyeing is effected by adding dyestuff to said coating solution.

5. The method of claim 3 wherein said dyeing is effected after drying said coated material.

6. The method of claim 5 wherein said dried, coated material is first dyed and then stretched.

* * * * *